United States Patent [19]

Hoffman

[11] Patent Number: 4,813,679

[45] Date of Patent: Mar. 21, 1989

[54] VARIABLE POSITION BOARD GAME

[76] Inventor: David G. Hoffman, 523 Weizmann, San Antonio, Tex. 78213

[21] Appl. No.: 24,536

[22] Filed: Mar. 11, 1987

[51] Int. Cl.[4] ..... A63F 3/00

[52] U.S. Cl. ..... 273/248; 273/283; 273/284

[58] Field of Search ..... 273/155, 260, 261, 248, 273/275, 283, 284, 258

[56] References Cited

U.S. PATENT DOCUMENTS

| | | | |
|---|---|---|---|
| 998,233 | 7/1911 | Crocker | 273/258 |
| 1,092,599 | 4/1914 | Scilling | 273/284 |
| 1,167,394 | 1/1916 | Foster | 273/283 |
| 2,352,555 | 6/1944 | Mandl | 273/155 |
| 3,163,425 | 12/1964 | Caplan | 273/284 |
| 3,804,418 | 4/1974 | Sanders | 273/284 |
| 4,234,185 | 11/1980 | Alsip | 273/284 |

*Primary Examiner*—Richard C. Pinkham

*Assistant Examiner*—Benjamin Layno

*Attorney, Agent, or Firm*—Thomas E. Sisson

[57] ABSTRACT

A strategy oriented board game wherein the board is divided into a plurality of elongated slidable strips. A first set of strips have intersections formed by first parallel lines intersecting second parallel lines. A second set of strips have similar intersections relatively offset from the intersections of the first set of strips. When the edges of the strips are aligned, the parallel lines are all connected forming linear intersecting pathways running diagonally across the face of the strips. Each player has a plurality of markers which are placed at home positions at opposite ends of the board. The markers are selectively movable across the strips along the pathways formed by the connection of the parallel lines. The objective is to move a player's marker to the opponent's home positions. According to the rules the strips may be slid, thereby re-positioning the markers located on the slid strip.

1 Claim, 9 Drawing Sheets

VARIABLE POSITION BOARD GAME

BACKGROUND OF THE INVENTION

This invention relates to an amusement device and more particularly to a game board having a plurality of elongated sliding members having geometric indicia thereon.

There are several patents which disclose game boards having slidable elongated members or movable playing fields. U.S. Pat. No. 3,731,934 (Shoptaugh) discloses a game board having a series of sliders with spaces thereon for the playing pieces and for containing barrier elements. While the sliders are mounted for limited lateral movement between home positions disposed at opposite sides of the board, each slider has two rows of spaces and barrier elements arranged to separate adjacent spaces in one row and to separate a space in one row from the aligned space in another row.

U.S. Pat. No. 3,820,793 (Palmer) discloses an amusement device providing a changeable labyrinth or maze having a plurality of elongated movable elements arranged in side by side relationship in a tray. Each of the elements has indicia thereon and the indicia on the elements collectively form a maze pattern which, in almost all arrangements of the elements, has at least one unobstructed pathway from one side edge of the elements to the other.

U.S. Pat. No. 4,541,635 (Shoptaugh) also discloses a board game structure consisting of a plurality of playing pieces and a game board on which the playing pieces are moved. The patent discloses a plurality of elongated rectilinear sliders mounted on the board for movement in side to side relationship to each other at a given common angle to the axis of the board.

However, the prior art does not disclose an amusement device having a multiplicity of intermediate slidable strips having various geometric indicia thereon which are capable of being independently varied laterally in either direction without boundary limits. Further, the prior art does not disclose the combination of the sliding strips, the particular geometric arrangement on the strips, or the method for using the elements of the present invention.

SUMMARY OF THE INVENTION

According to the present invention, there is provided a variable position game board amusement device. The device comprises two base strips on which are positioned intersections defining home positions or home bases. The two base strips are positioned on opposite sides of a playing surface. No particular playing surface is required, however, preferably a horizontal, flat surface is utilized. Disposed between the two base strips are two different types of intermediate strips which are independently slidable at right angles to the right and to the left of the axis between the base strips Further, in certain moves in the game, the base strips may be moved at right angles either to the right or to the left of the axis between the strips. On the exposed faces of all of the strips are a series of parallel lines running diagonally across the face of the strips and intersecting with oppositely running parallel lines to form intersections which are designated positions for selectively moving a plurality of markers across the strips from one base strip to the other base strip along the pathway formed by the visual connection of the parallel lines on the strips. It is the objective of the game to be the first player to move all of his markers across the board from his home base diagonally along the parallel lines to his opponent's home base.

DESCRIPTION OF THE PREFERRED EMBODIMENT

Figure 1:
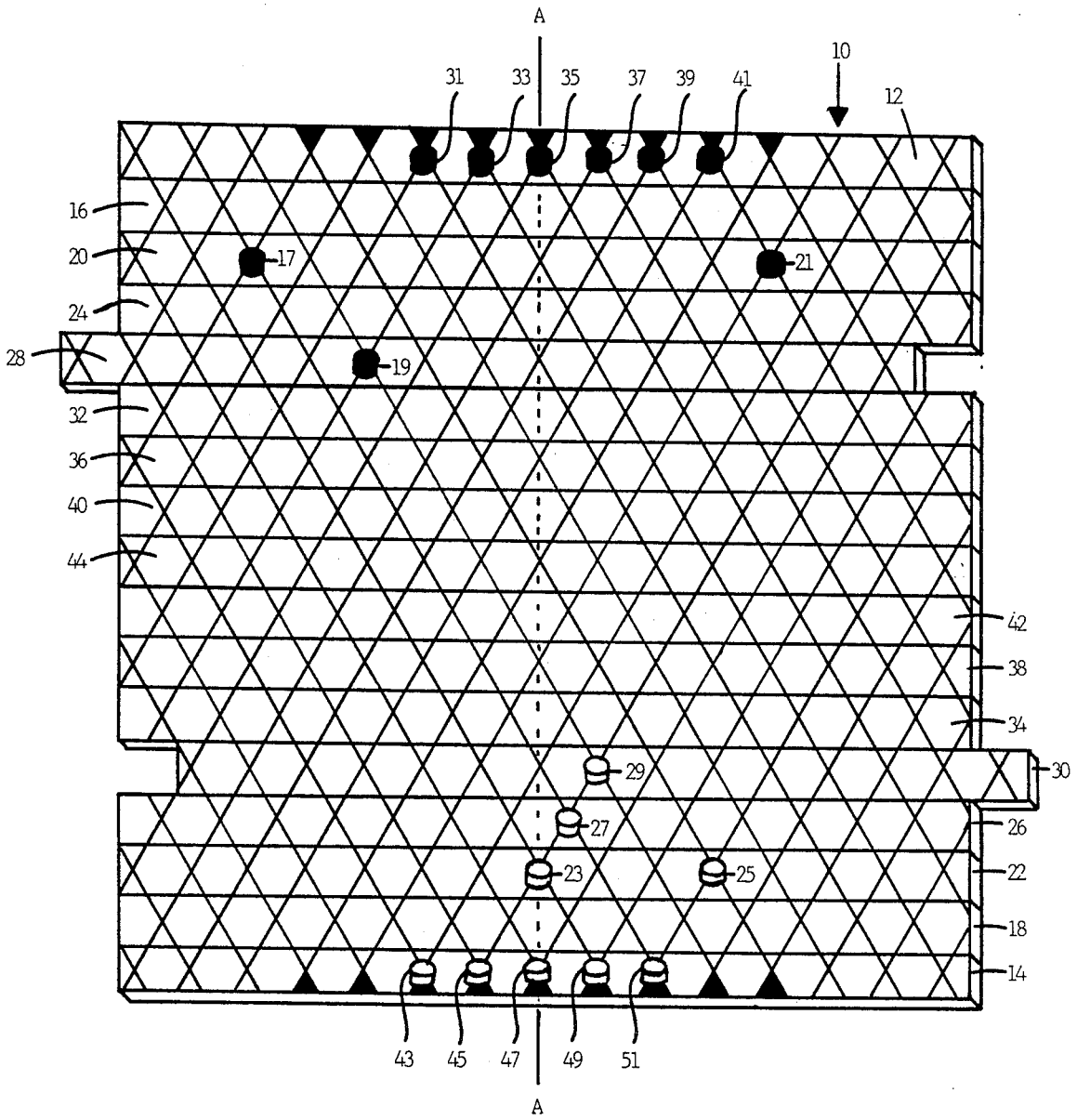
FIG. 1 is a perspective view of the invention illustrating its assembly.

Referring to the drawings by numerals of reference, and more particularly to FIG. 1, there is shown a variable position game board apparatus 10. A first base strip 12 is positioned opposite a second base strip 14 on a generally flat, horizontal playing surface (not shown). Abutting against base strip 12 is a first intermediate strip 16 while abutting against base strip 14 is another first intermediate strip 18. Abutting against first intermediate member 16 is a second intermediate member 20 while abutting against first intermediate member 18 is another second intermediate member 22. As can be seen in FIG. 1, first and second intermediate strips are alternatingly positioned in side by side relationship between base strips 12 and 14. All first intermediate strips are identical to each other. First intermediate strips are designated by numerals 16, 18, 24, 26, 32, 34, 40, and 42. Likewise, all second intermediate strips are identical to each other. Second intermediate strips are designated by numerals 20, 22, 28, 30, 36, 38, and 44.

FIG. 1 also illustrates strip 28 having been shifted to the left of axis A—A between base strips 12 and 14, while strip 30 has been shifted to the right. As will be discussed below, shifting strips enables a player to position either his marker or his opponent's marker in position for legal moves.

Further, FIG. 1 illustrates one player's markers 17, 19, and 21 and his opponent's markers 23, 25, 27, and 29 positioned along the pathway lines on the strips at designated positions, while the player's other markers 31, 33, 35, 37, 39, and 41 are still on his home bases. The opponent has markers 43, 45, 47, 49, and 51 resting on his home bases.

It should be noted in FIG. 1 that where strips 28 and 30 have been shifted, the parallel lines (discussed below) have been realigned to form a continuous visual connection across the face of the strips. These continuous, visually connected lines define the diagonal pathways for the legal movement of the markers.

Referring to FIGS. 2A–2D, the four basic elongated sliding strips of the present invention are illustrated. Base strips 12 and 14 are identical except that home positions 13 on strip 12 and 15 on strip 14 are colored on opposite sides of the centerline (designated B—B, and C—C, respectively) of each strip. The home base positions 13 on strip 12 are of one color while the home base positions 15 on base strip 14 are another color.

Figures 2A, 2B, 2C, 2D:
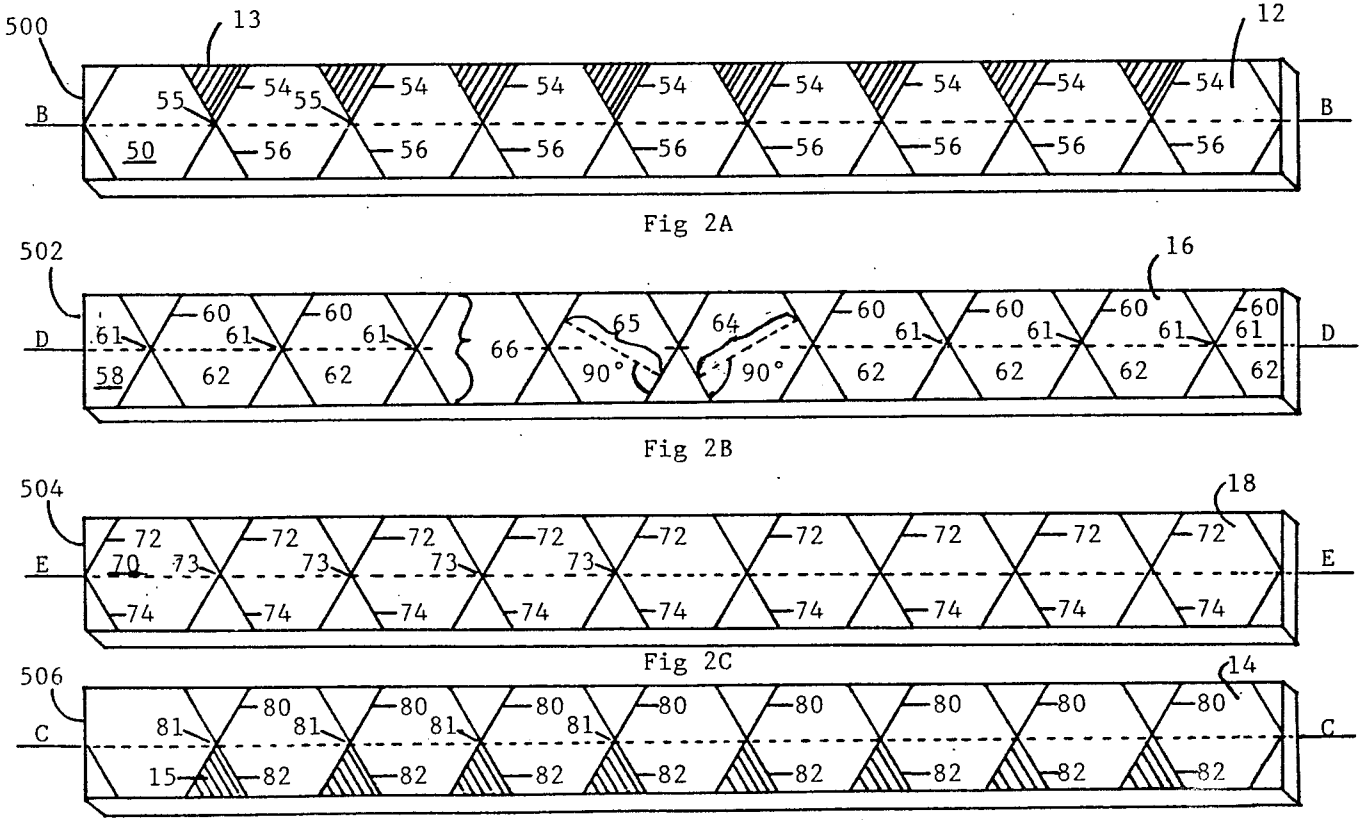
FIGS. 2A–2D are perspective views of each of the slidable strips of the present invention.

The geometric indicia on the exposed face 50 on strip 12 consists of a series of first parallel lines 54 extending diagonally across the face 50. A second series of parallel lines 56 extend opposite of the first series of parallel lines 54 and diagonally across the exposed face 50. As can be seen in FIG. 2A, lines 54 and 56 intersect at the approximate centerline B-B of base strip 12. The shaded triangular portion behind the intersection forms the home base 13 for base strip 12.

A typical first intermediate strip 16 is shown in FIG. 2B. The geometric indicia on the exposed face 58 of strip 16 consists of a series of third parallel lines 60 extending diagonally across the face 58 of strip 16 and a fourth series of parallel lines 62 extending opposite the third series of parallel lines 60 and diagonally across the exposed face 58. In the preferred embodiment the distance between parallel lines 60 (distance shown by numeral 64) and between parallel lines 62 (distance shown by numeral 65) is equal to the width 66 of strip 16. As can be seen in FIG. 2B, lines 60 and 62 intersect at the approximate centerline D—D of first intermediate strip 16. While the geometric indicia on the exposed face 58 of strip 16 initially appears to be identical to that on base strips 12 and 14, it should be noted that intersection 61 of lines 60 and 62 is shifted to the right of intersection 55 on strip 12 when the left 500 edge of strip 12 is aligned with the left edge 502 of strip 16, since strips 12 and 16 are substantially equal in length as noted in FIGS. 2A and 2B. Thus each intersection on the first intermediate strips is shifted to the right of the base strip intersection. These intersections on the intermediate strips define designated spaces as discussed hereinbelow.

FIG. 2C illustrates a typical second intermediate strip 18 which is representative of all second intermediate strips utilized in the present invention. Strip 18 has a centerline designated E—E. The geometric indicia on the exposed face 70 of strip 18 consists of a fifth series of parallel lines 72 extending diagonally across the face 70. A sixth series of parallel lines 74 extend opposite the fifth series of parallel lines 72 and diagonally across the exposed face 70. As with the other strips, parallel lines 72 and 74 intersect at the approximate centerline E—E of strip 18. The alignment of intersections 73 of lines 72 and 74 corresponds to the alignment of intersections 55 and 81 on base strips 12 and 14, respectively, when the left edge 504 of strip 18 is aligned with the left edges 500 and 502 of strips 12 and 16, respectively, since strips 12, 16, and 18 are substantially equal in length as noted in FIGS. 2A, 2B, and 2C.

Base strip 14 has home base positions 15 on exposed face 52 as seen in FIG. 2D. The geometric indicia on face 52 of strip 14 is almost identical to that of base strip 12 in that parallel lines 80 extend diagonally across face 52 of strip 14 and correspond to first series of parallel lines 54 on strip 12. Parallel lines 82 extend opposite parallel lines 80 and diagonally across the face 52 of strip 14 and correspond to parallel lines 56 of strip 12. Parallel lines 80 and 82 intersect at the approximate centerline C—C of strip 14. The alignment of the intersections 81 of lines 80 and 82 aligns with the intersections 55 on strips 12 and intersections 73 on all second intermediate strips. When the left edge 506 of strip 14 is aligned with the left edges 500, 502, and 504 of strips 12, 16, and 18, respectively, since strips 12, 14, 16, and 18 are substantially equal in length as noted in FIGS. 2A, 2B, 2C, and 2D. The only difference between strips 12 and 14 is that the colored home positions 15 on strip 14 are on the opposite side of the intersections to the home positions 13 on strip 12.

There are two base strips in the instant invention and an even number of first intermediate strips and an odd number of second intermediate strips. As can be seen in FIG. 1, one of the first intermediate strips 16 is positioned immediately adjacent to base strip 12 and one of the first intermediate strips 18 is placed immediately adjacent to base strip 14. As can be seen in FIG. 1, the placement of first intermediate strips 16 and 18 is between base strips 12 and 14. First intermediate strips 16 and 18 are positioned in side by side relationship to base strips 12 and 14 respectively and are movable at right angles to the right and left of the axis A—A between base strips 12 and 14. Further, FIG. 1 illustrates the placement of second intermediate strips 20 and 22 in side by side relationship to first intermediate strips 16 and 18. Again, strips 20 and 22 are slidable at right angles to the right and to the left of the axis A—A between base strips 12 and 14. First intermediate strip 16 (FIG. 2B and FIG. 1) is abutted against base strip 12 (FIG. 2A and FIG. 1) such that the parallel lines 60 are visually connected to parallel lines 54 and parallel lines 62 visually connected to parallel lines 56. As will be discussed hereinbelow, when certain strips are moved to the right or to the left of the axis between the base strips then at least a portion of parallel lines 54 align with parallel lines 60 and at least a portion of parallel lines 56 visually connect with parallel lines 62.

When second intermediate strip 18 (FIG. 2C) is abutted against first intermediate strip 16 (FIG. 2C) parallel lines 72 are visually connected to parallel lines 60 while parallel lines 74 visually connect with parallel lines 62 of strip 16.

First intermediate strips 24, 26, 32, 34, 40, and 42 are alternatingly positioned in side by side relationship with second intermediate strips 28, 30, 36, 38, and 44 as shown in FIG. 1.

Figure 3:
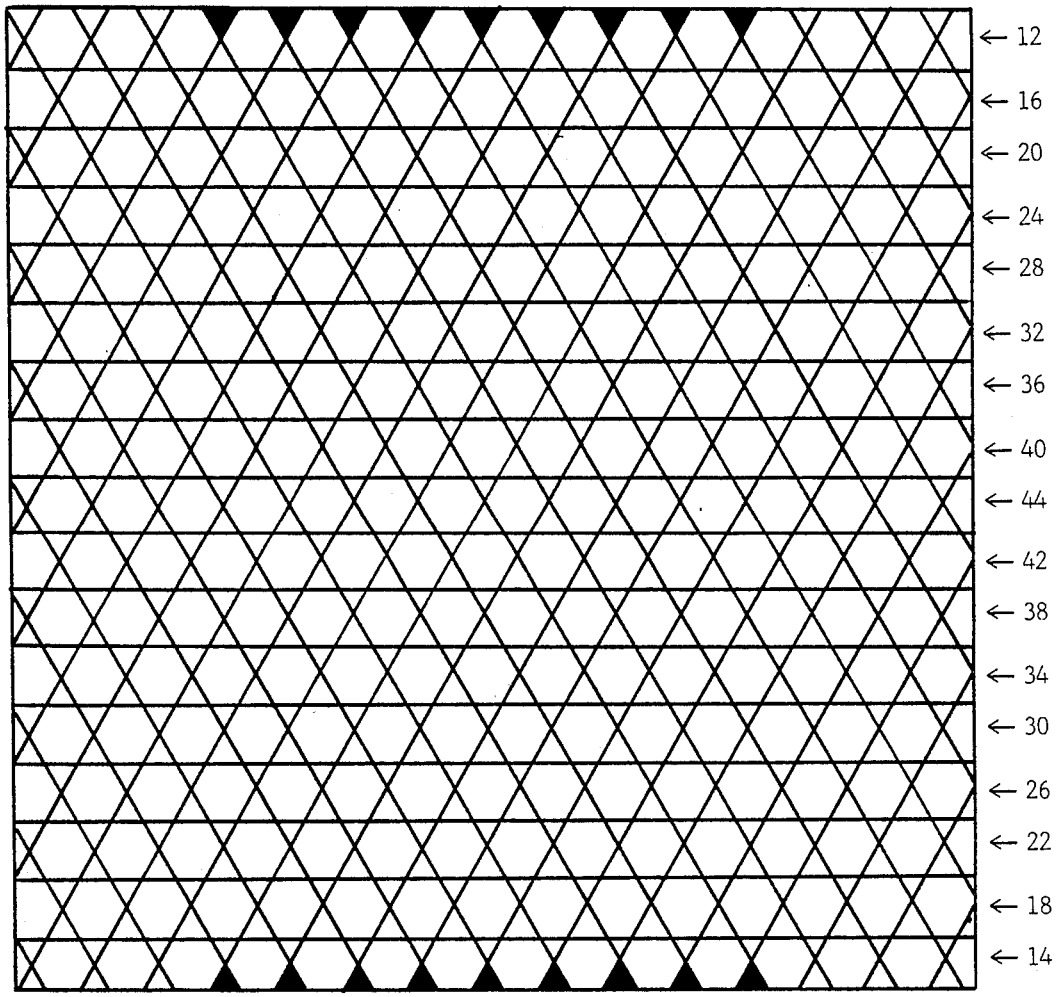
FIG. 3 is a top plan view of the invention showing the goemetric indicia of the playing field of the present invention.

FIG. 3 is a top view of the playing field of the present invention showing the relationship of the various geometric indicia on the base strips 12 and 14 and the first intermediate strips 16, 18, 24, 26, 32, 34, 40, and 42 and the second intermediate strips 20, 22, 28, 30, 36, 38, and 44 as they appear at the beginning of a game. As can be seen from FIG. 3, the various parallel lines on each strip are visually connected to corresponding parallel lines on the adjacent strip as discussed above.

To play the game each player rolls their die with the highest roll determining the first play. A player's turn consists of rolling his die and using the number which comes up as the number of moves to move any of his markers. The objective is to move one or more of a player's markers in all of the four legal moves (discussed below) in any combination to selectively move the player's markers across the board to his opponent's home positions. Players alternate turns.

Figure 4:
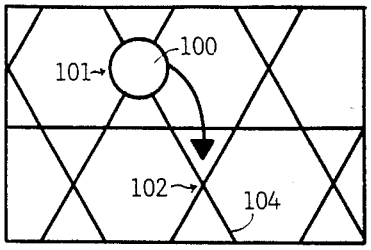
FIG. 4 is a top plan view of the playing field showing an adjacent move.

A legal move must be diagonally along the parallel lines extending across the exposed face of the strips as discussed below. In FIG. 4, an "adjacent move" is shown. Player A moves his marker 100 from designated positon 101 forward or backward along parallel line 104 to an adjacent intersection or designated space 102.

Figure 5:
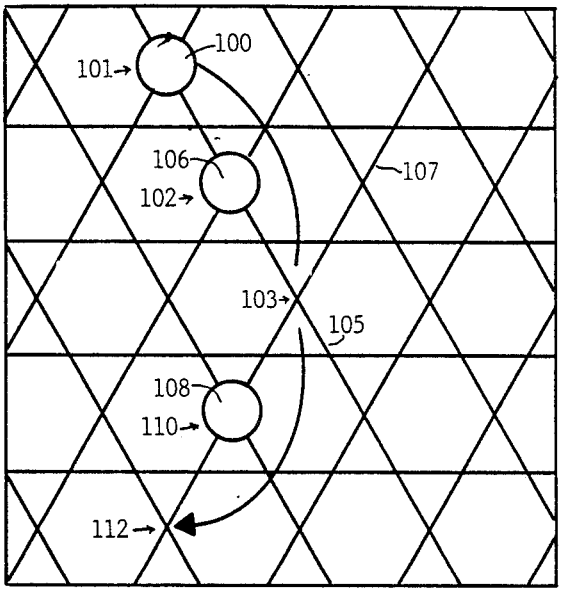
FIG. 5 is a top plan view of the playing field showing a series of adjacent jumps.

FIG. 5 illustrates a legal move called "adjacent jumping." A player may jump his marker 100 over any adjacent marker 106 whether adjacent marker 106 is his own marker or that of his opponent. The jump must be diagonally along one of the parallel pathway lines such as 105 and 107. One may continue to jump adjacent markers until there are no more possible jumps. Such adjacent jumps may be done in any direction at any time during that one move so long as they are diagonally along the parallel pathway lines. The example shown in FIG. 5 illustrates marker 100 on intersection 101 jumping over an adjacent marker 106 on intersection 102 along parallel line 105. Marker 100 is now on intersection 103 and may jump over another adjacent marker 108 on intersection 110 terminating the move and coming to rest on intersection 112 having moved along parallel pathway line 107. These two consecutive adjacent jumps only use up one of a player's moves.

Figure 6:
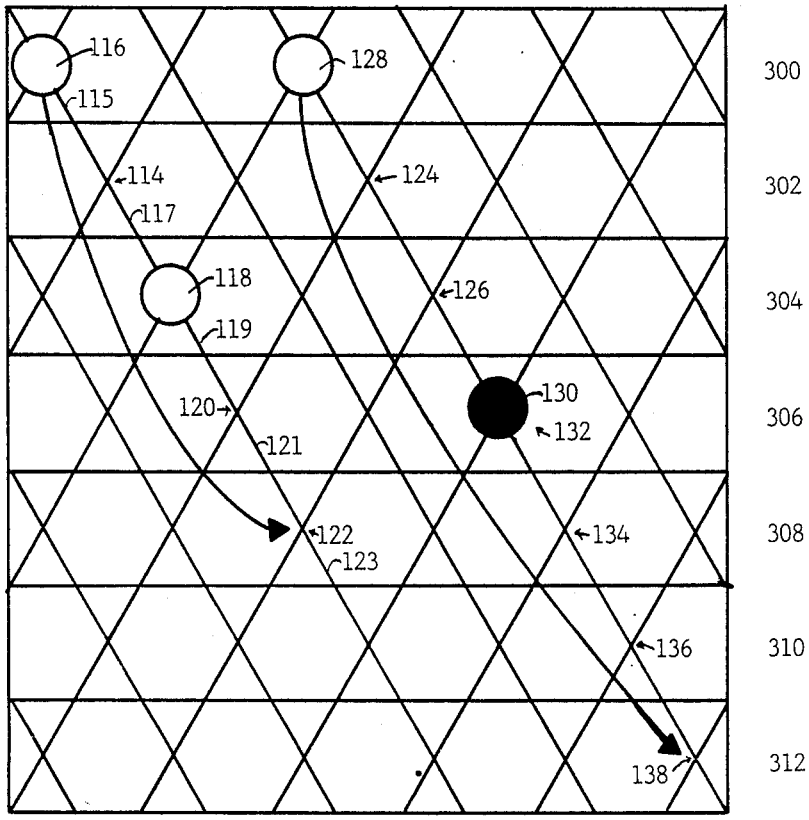
FIG. 6 is a top plan view of the playing field showing long jump situations and moves.

FIG. 6 illustrates the legal move known as "long jumping." A long jump may be made to an intersection which is an equal distance on the other side of a marker the player wants to jump, whether the jumped marker is the player's own marker or his opponent's marker, provided there are empty intersections on either side of the jumped marker. In the example of FIG. 6 two long jumps are illustrated. The first long jump shows an empty intersection 114 between the player's marker 116 and the marker 118 to be jumped. Intersection 120 on the other side of marker 118 is empty and intersection 122 which is an equal distance away on the other side of marker 118 is also open and thus allows marker 116 to make the long jump. Again, the move or jump is diagonally along parallel line 115 on strip 300, line 117 on strip 302, line 119 on strip 304, line 121 on strip 306 and line 123 on strip 308, all of these lines being visually connected when the respective strip is abutted against the next strip in a side-by-side relationship. This same concept of the long jump is also illustrated in the second example in FIG. 6 but this time there are two empty intersections 124 and 126 between marker 128 and the marker 130 to be jumped. In this particular example, marker 130 is the opponent's marker. Marker 130 is on intersection 132. Thus, marker 128 may be long jumped to intersection 138 because intersections 134, 136, and 138 are empty. As can be seen in FIG. 6, this long jump is diagonally along the parallel lines of the strips.

There is no limit as to how long a "long jump" may be. In fact, it is possible to long jump a player's marker from his home base across to the opponent's home base in a single bound.

Figure 7:
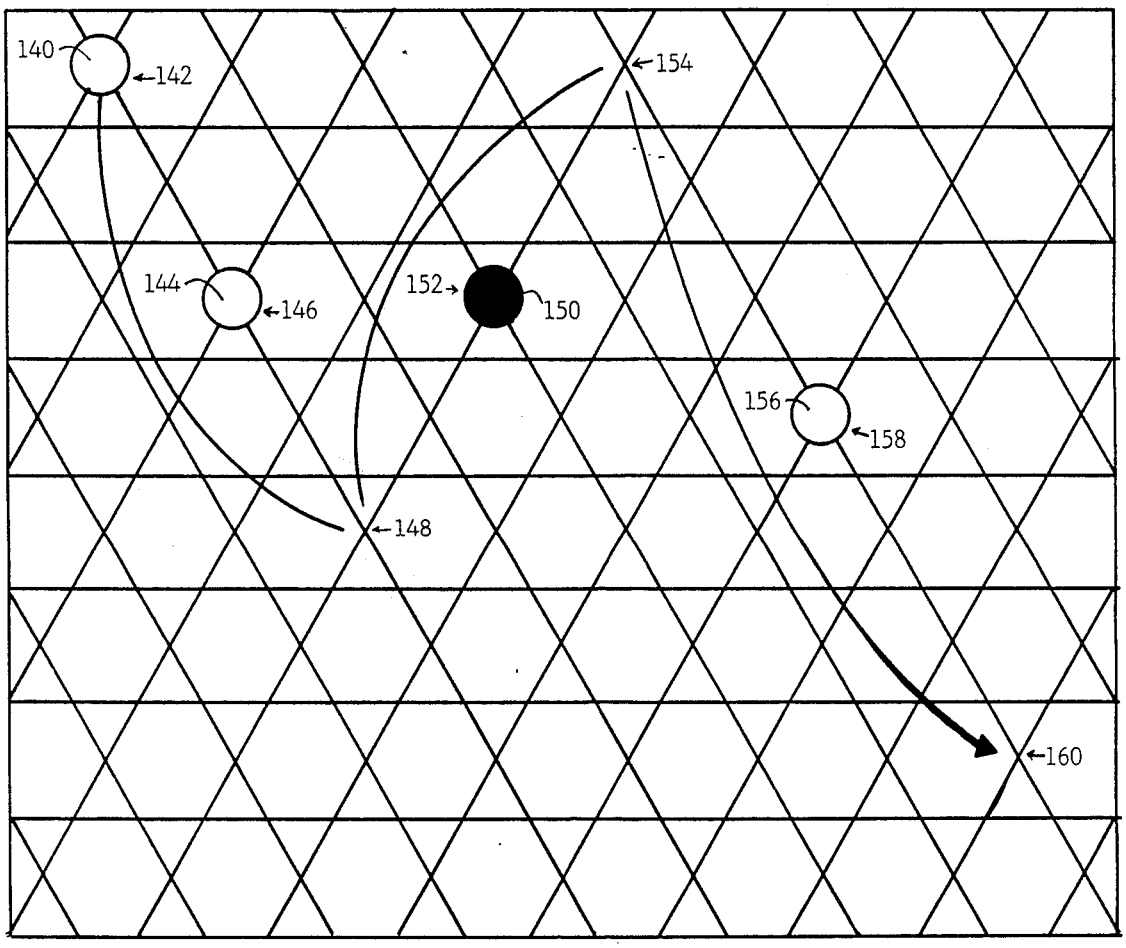
FIG. 7 is a top plan view of the playing field showing a series of long jumps during a single move.

Similar to jumping adjacent markers, one may make multiple long jumps during a single move. FIG. 7 illustrates multiple long jumps during a single move. Marker 140 on intersection 142 begins its move by long jumping over marker 144 on intersection 146 to intersection 148. This move has not yet ended since marker 140 may long jump again over marker 150 on intersection 152, landing on intersection 154 and then long jumping over marker 156 on intersection 158 finally completing the move coming to rest on intersection 160. This was one complete move. This move has allowed marker 140 to travel diagonally along the parallel lines shown in FIG. 7. Jumping over more than one marker with a single jump is not allowed.

Figure 8:
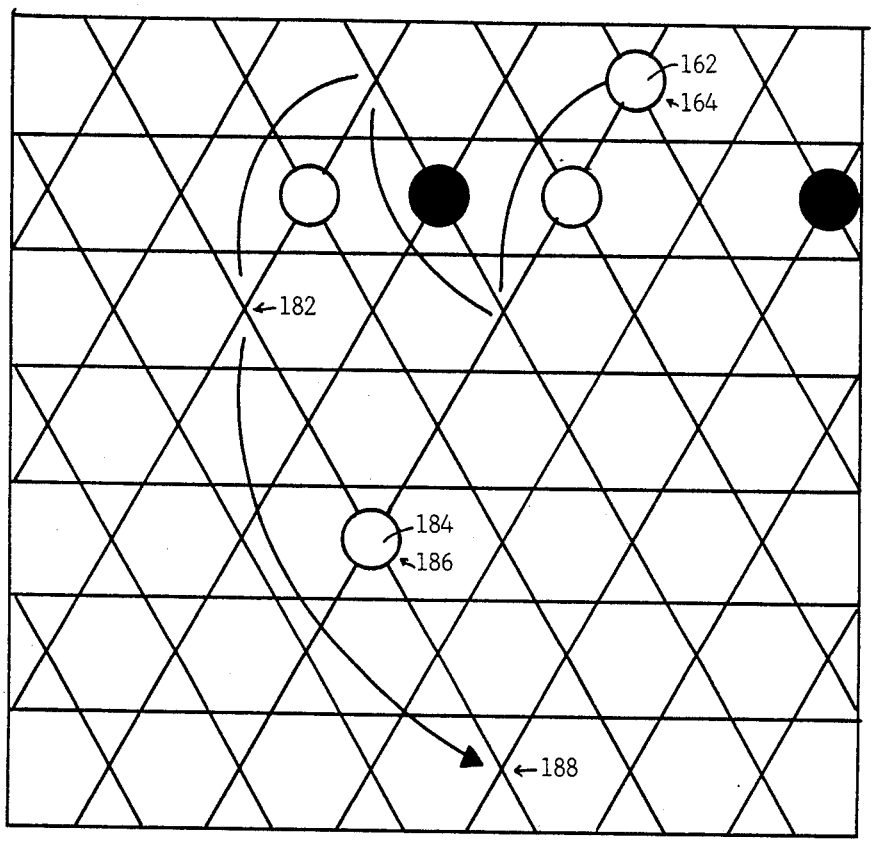
FIG. 8 is a top plan view of the playing field showing a combination of adjacent jumps and long jumps.

Both "adjacent" and "long jumps" may be combined when making multiple jumps during a single move. FIG. 8 shows how marker 162 on intersection 164 makes three consecutive adjacent jumps forward and backward diagonally along the parallel lines in order to get to intersection 182. From there, it is possible for marker 162 to long jump over the marker 184 on intersection 186 coming to rest on intersection 188. All of these jumps, when made consecutively, will utilize only one move.

Figure 9:
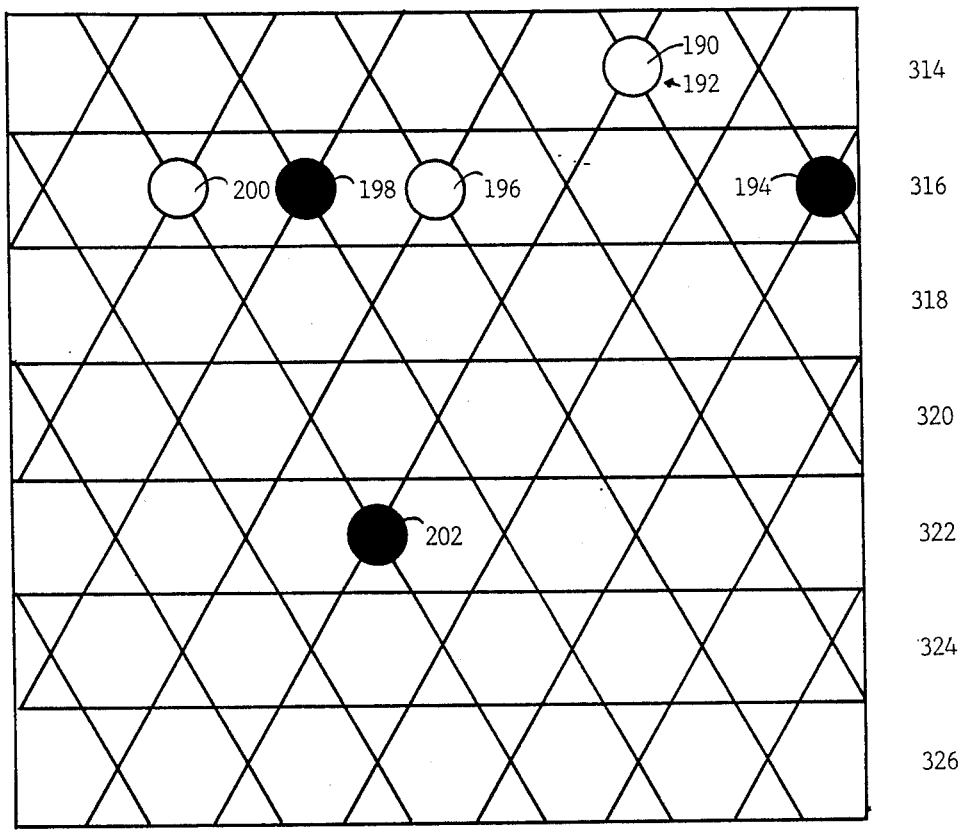
FIG. 9 is a top plan view of the playing field showing a situation of the playing markers prior to a particular strip being moved.
Figure 10:
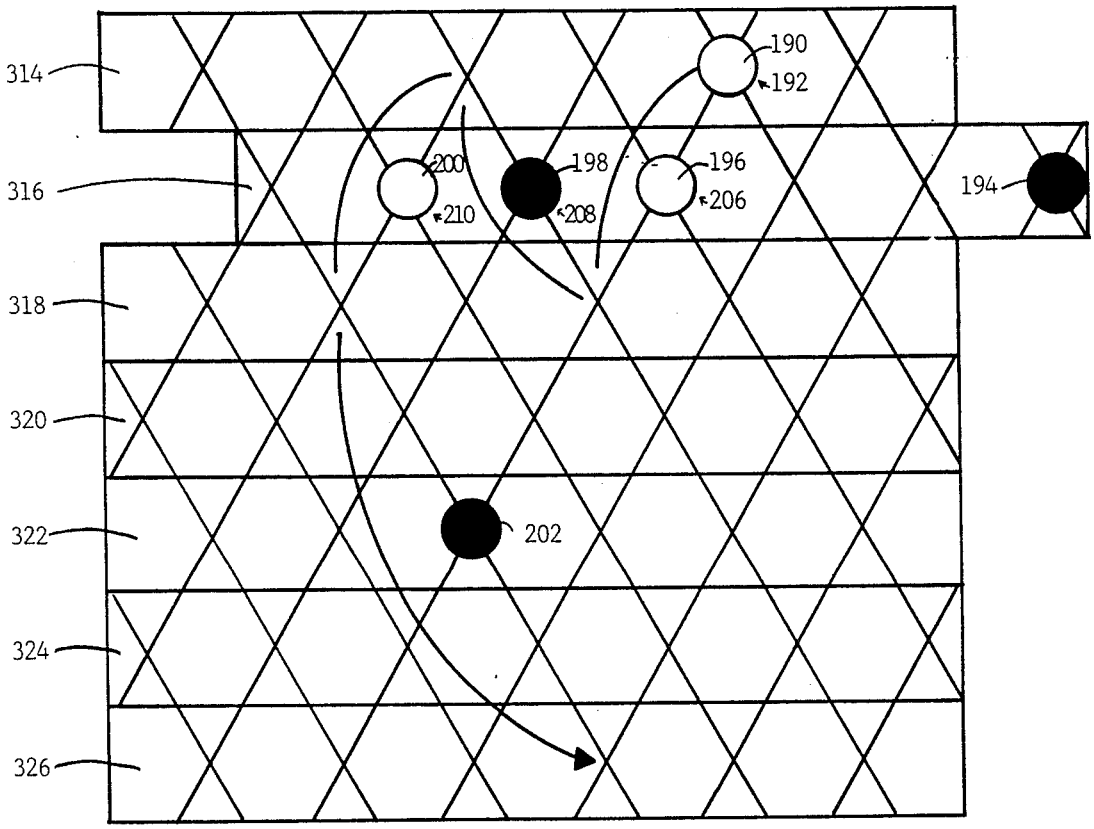
FIG. 10 is a top plan view of the playing field after a particular strip has been moved.

FIGS. 9 and 10 illustrate the variability of the strips to increase the complexity of play and shows the movement of the strips in side by side relationships to increase the number of possible move combinations available in the game.

A player may vary or slide a board strip to the right or to the left of the axis between home strips to position his own markers or his opponent's markers so that another jump or move may be completed. Varying one position would be sliding a strip either to the left or to the right one position until the parallel lines are visually reconnected; this would be considered one move. Varying a board strip may be done before or after other types of moves. If desired, a player may use all of his or her moves varying one or more strips.

Referring to FIGS. 9 and 10 one can see an example demonstrating varying a playing board strip on position for one move. In FIG. 9 there are no jumps possible for the marker 190 at intersection 192 due to the current positions of markers 194, 196, 198, 200, and 202. Markers may not be moved across parallel lines, but only along the pathways defined by the parallel lines on the exposed faces of the strips. FIG. 10 shows that by varying intermediate strip 316 one position to the right, marker 196 on intersection 206 of strip 316, marker 198 on intersection 208 of strip 316, and marker 200 on intersection 210 on strip 316 are repositioned so that marker 190 on intersection 192 of strip 314 may make the multiple or combination of jumps such as previously described and illustrated in FIG. 8. Because varying intermediate strip 316 one position consumes one move, a roll of at least two on the die would be required to make the move combination shown in FIGS. 9 and 10.

Figure 11:
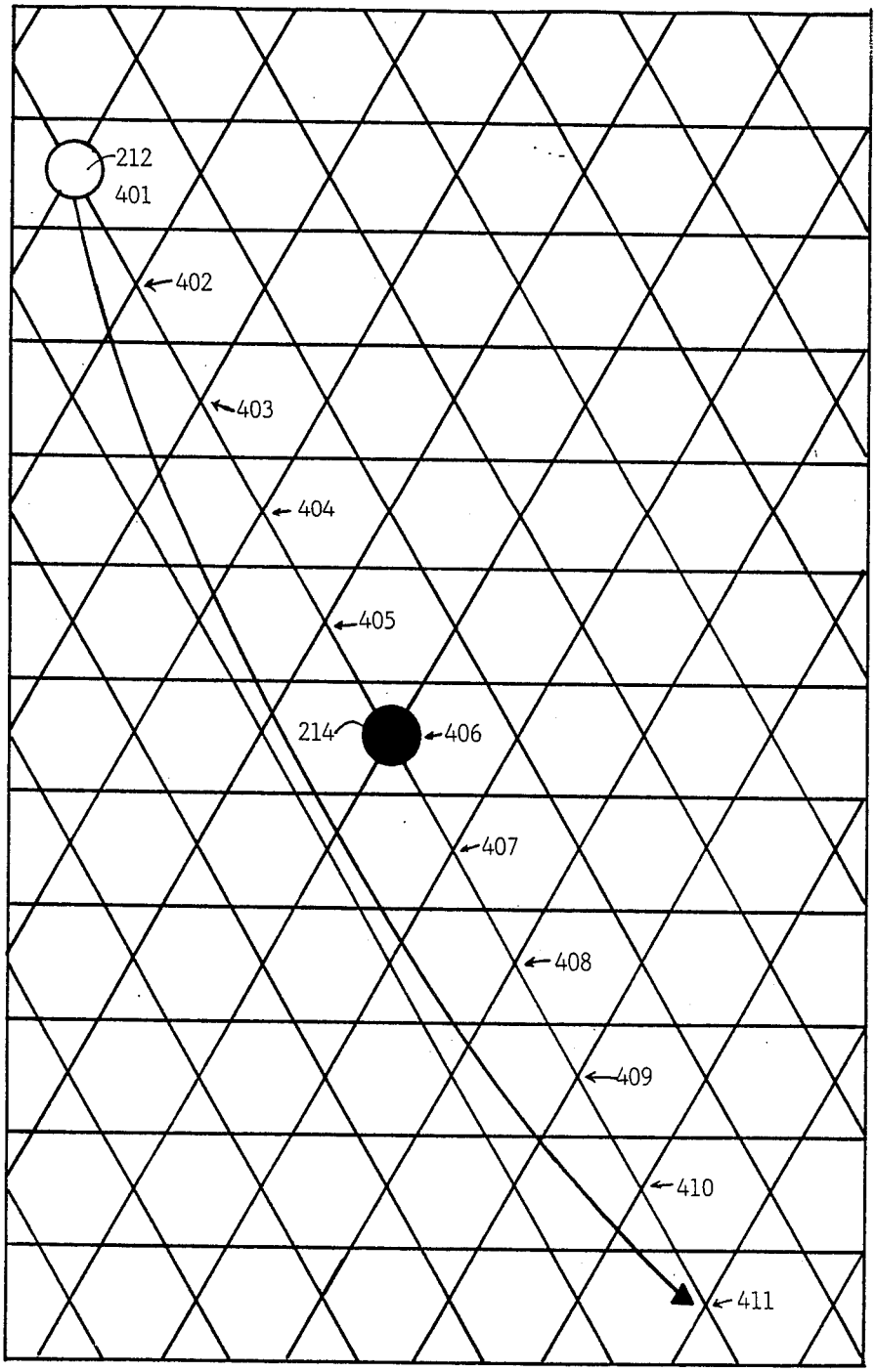
FIG. 11 is a top plan view of the playing field showing a return to home base jump.

An interesting variation on the method of utilizing the present invention involves the ability to return an opponent's marker back to one of the opponent's home bases if during a player's first move of a turn the player is able to long jump over an opponent's marker by greater than three intersections. In this "return to home base" jump, a player cannot shift a strip thereby positioning either the player's marker or his opponent's such that there are more than three intersections between the player's marker and the opponent's. To shift the strip first would have been to use the first move of a player's turn thereby making the proposed jump sending the opponent's marker back to home base the second move of the player's turn. The purpose of the rule allowing an opponent's marker to be sent back to home base is to penalize the opponent for his own oversight in completing his own turn and leaving his marker in a situation whereby the long jump over his marker by greater than three intersections can be completed by his opponent on his opponent's first move. FIG. 11 illustrates a situation where a player has completed his turn and left marker 214 on intersection 406. Because there are greater than three empty intersections on either side of marker 214 and his opponent's marker 212 is positioned to make the long jump, his opponent, on his first move, may make this long jump and send marker 214 back to home base.

While it has been shown described and pointed out the fundamental novel features of the invention as applied to a preferred embodiment thereof, it will be understood that various omissions, substitutions and changes in the form and details of the device illustrated and in its operation may be made by those skilled in the art without departing from the spirit of the invention. It is the intention, therefore, to be limited only as indicated by the scope of the claims appended hereto.

We claim:

1. An amusement device to be played by a plurality of players comprising in combination:

first and second base strips positioned on opposite sides of a playing surface, said first and second base strips having a first geometric indicia on an exposed face of said base strips, said first geometric indicia comprising a series of first parallel lines extending diagonally across said exposed face and a series of second parallel lines extending opposite said first series of parallel lines and diagonally across said exposed face, said first and said second series of parallel lines intersecting across said exposed face at an approximate centerline of each of said base strips, said intersections defining home positions, said first and second series of parallel lines spaced apart a distance equal to the width of said base strips;

an even number of first intermediate strips having a second geometric indicia on an exposed face of said first intermediate strips, said second geometric indicia comprising a series of third parallel lines extending diagonally across said exposed face of said first intermediate strips and a series of fourth parallel lines extending opposite said third series of parallel lines and diagonally across said exposed face of said first intermediate strips, said third and fourth series of lines intersecting across said exposed face of said first intermediate strips at an approximate centerline of each of said first intermediate strips, said intersections defining designated positions, said third and fourth series of parallel lines spaced apart a distance equal to the width of said first intermediate strips, one of said first intermediate strips positioned immediately adjacent to each of and between said base strips such that at least one of said first series of parallel lines abuts and visually connects to at least one of said third series of parallel lines and at least one of said second series of parallel lines abuts and visually connects to at least one of said fourth series of parallel lines;

an odd number of second intermediate strips having a third geometric indicia on an exposed face of said second intermediate strips, said third geometric indicia comprising a series of fifth parallel lines extending diagonally across said exposed face of said second intermediate strips and a series of sixth parallel lines extending opposite said fifth series of parallel lines and diagonally across said exposed face of said second intermediate strips, said fifth and sixth series of lines intersecting across said exposed face of said second intermediate strips at an approximate centerline of each of said second intermediate strips, said intersections defining said designated positions, said fifth and sixth series of parallel lines spaced apart a distance equal to the width of said second intermediate strips, said second intermediate strips positioned between said base strips and immediately adjacent to and alternatingly with said first intermediate strips such that at least one of said fourth series of parallel lines abuts and visually connects to at least one of said sixth series of parallel lines and at least one of said third series of parallel lines abuts and visually connects to at least one of said fifth series of parallel lines, said base strips, said first intermediate strips, and said second intermediate strips independently slidable at right angles to the right and to the left of the axis between said base strips without any boundary limits;

said first and second base strips and said first intermediate and second intermediate strips all being of substantially equal length, said intersections defining designated positions on said first intermediate strips offset to the right of said intersections on said first and second base strips and said second intermediate strips when the edges of all of said strips are aligned;

a plurality of markers having indicia thereon whereby each player's marker can be readily distinguished; and said amusement device being adapted for play with said plurality of markers selectively movable across said strips along pathways formed by the visual connection of said parallel lines and said designated positions, said plurality of markers being at all times visible to said players and maintained on said designated positions when said first intermediate strips are slid such that only one of said first series of parallel lines abuts and visually connects to only one of said third series of parallel lines or said second intermediate strips are slid such that only one of said fourth series of parallel lines abuts and visually connects to only one of said sixth series of parallel lines.

* * * * *